US007908800B2

(12) United States Patent
Bach Lahor

(10) Patent No.: US 7,908,800 B2
(45) Date of Patent: Mar. 22, 2011

(54) MODULAR COLUMBARIUM

(75) Inventor: Santiago Bach Lahor, Barcelona (ES)

(73) Assignee: Marcs Urnas Bach, S.L., Terrassa (Barcelona) (ES)

( * ) Notice: Subject to any disclaimer, the term of this patent is extended or adjusted under 35 U.S.C. 154(b) by 371 days.

(21) Appl. No.: 12/183,189

(22) Filed: Jul. 31, 2008

(65) Prior Publication Data

US 2009/0229197 A1 Sep. 17, 2009

(30) Foreign Application Priority Data

Mar. 11, 2008 (ES) ..... 200800506

(51) Int. Cl.
*E04H 13/00* (2006.01)

(52) U.S. Cl. ..... 52/142; 52/128; 52/137; 52/136; 52/126.1; 52/36.5; 312/265.2; 312/257.1; 312/265.3; 312/100; 312/107; 211/85.27

(58) Field of Classification Search ..... 52/128, 52/134, 136, 137, 139, 142, 126.1, 126.6, 52/36.5, 36.6; 312/257.1, 265.2, 265.3, 265.6, 312/100, 107, 108; 211/85.27
See application file for complete search history.

(56) References Cited

U.S. PATENT DOCUMENTS

| | | | | | |
|---|---|---|---|---|---|
| 1,406,192 | A * | 2/1922 | Kennedy | 312/107 |
| 4,064,664 | A * | 12/1977 | Gaul | 52/136 |
| 4,261,470 | A * | 4/1981 | Dolan | 211/191 |
| 4,433,883 | A * | 2/1984 | Boender et al. | 312/234.1 |
| 5,408,787 | A * | 4/1995 | Barnett | 52/134 |
| 5,639,150 | A * | 6/1997 | Anderson et al. | 312/265.3 |
| 6,250,025 | B1 * | 6/2001 | Darby | 52/137 |
| 6,363,663 | B1 * | 4/2002 | Kane et al. | 52/36.6 |
| 6,467,640 | B1 * | 10/2002 | Hung | 220/4.02 |
| 7,415,800 | B2 * | 8/2008 | Stienwand | 52/136 |
| 7,498,512 | B2 * | 3/2009 | Adducci et al. | 174/50 |
| 2004/0177570 | A1 * | 9/2004 | Stienwand | 52/133 |
| 2007/0175110 | A1 * | 8/2007 | Bosisio et al. | 52/136 |

FOREIGN PATENT DOCUMENTS

| | | | |
|---|---|---|---|
| ES | 1 056 739 | | 5/2004 |
| GB | 2095101 | A * | 9/1982 |

* cited by examiner

*Primary Examiner* — Robert J Canfield
*Assistant Examiner* — Matthew J Gitlin
(74) *Attorney, Agent, or Firm* — Michael J. Striker

(57) ABSTRACT

A modular columbarium has side panels joined to front uprights by bolts on bent front tabs on the front panels and, respectively, the panels are joined to the rear uprights by L-shaped tabs that can be housed in slot in the rear uprights. The bottoms of the front uprights are extended by height-adjustable legs to adapt to any unevenness of the ground, a lower base panel being fastened between the legs. The front uprights are connected to each other by font crossbars, the crossbars comprising a longitudinal guide, whereon blocking elements are positioned that can move laterally along them. The longitudinal guide has slots for the projecting tabs of the front covers to pass through. The guide has central openings wherethrough the blocking elements can be actuated to block or release the front covers.

15 Claims, 8 Drawing Sheets

MODULAR COLUMBARIUM

CROSS-REFERENCE TO A RELATED APPLICATION

The invention described and claimed hereinbelow is also described in Spanish Patent Application 200800506 filed on Mar. 11, 2008. This Spanish Patent Application, subject matter of which is incorporated herein by reference, provides the basis for a claim of priority of invention under 35 U.S.C. 119(a)-(d).

BACKGROUND OF THE INVENTION

Nowadays it is common for the deceased to have expressed a wish in life for the incineration or cremation of their body at their funeral and for their ashes to be placed somewhere in particular, either scattered or placed somewhere for a reason associated with their life. Therefore, the use of columbaria is common for placing urns containing the ashes of many people together, both in cemeteries and in special meaningful places such as hermitage chapels, sports clubs and others for reasons of devotion or interest.

Spanish utility model ES1053739U, which is held by the same applicant, discloses a columbarium of the type that comprises a modular structure with a number of uprights positioned at the front and rear of the unit, with side panels, rear panels and openable front covers on front crossbars, the unit being joined by conventional means. With this structure, it is possible to install a number of horizontal shelves that form the floor and ceiling of regular spaces positioned one above another in columns to house the cinerary urns. This structure can be laterally attached to an adjacent structure, the covers forming a matrix to which a mosaic, decorative elements or suchlike may be fastened.

This columbarium is lightweight and easy to transport to the place where it is to be installed, since the different elements are made from steel sheet and tubing, so it is possible to construct the columbarium without any need for building work. Furthermore, the columbarium can be finished with outer decoration that is symbolic of the place or site, if it has a special meaning, or using the desired decoration.

However, it consists of a large number of different pieces and its handling in the final location takes a great deal of time, therefore meaning that manufacturing costs are not sufficiently affordable and the assembly thereof requires specialised personnel.

SUMMARY OF INVENTION

The modular columbarium that is the object of this invention presents technical features that are designed to improve its lightness and production by reducing the number of different pieces and making its assembly simpler and more economical so that it may be constructed without specialised knowledge. The dimensions of the columbarium can also be easily adapted to the requirements of the place where it is to be installed.

Thus, the structure comprises side panels joined to front uprights by means of bolts on bent front tabs on said front panels and, respectively, the side panels are joined to the rear uprights by L-shaped tabs that can be housed in slots in said rear uprights. The bottoms of the front uprights are extended by height-adjustable legs to adapt to any unevenness of the ground, a lower base panel being fastened between the legs. Said front uprights are connected to each other by front crossbars, said crossbars comprising a longitudinal guide, whereon blocking elements are positioned that can move laterally along them. The longitudinal guide has slots for the projecting tabs of the front covers to pass through. Moreover, said guide has central openings where through the blocking elements can be actuated to block or release said front covers.

With this structure, the side dimensions of the columbarium can easily be adjusted according to the assembly requirements to add more adjacent structures, thus achieving a strong and resistant configuration thanks to this interconnection. The height can also be adjusted to the requirements of the site.

The rear panels are rectangular, with side tabs bent to one side whereby they are fastened to the slots in the rear uprights, so that they are secured between the side panels that define the width of a space where urns can be received and deposited.

Each front upright consists of a laminar piece with a U-shaped section, both side wings whereof have holes for the bolts that fasten the side panels, and the front side has groups of holes for attaching the longitudinal guides of the crossbars on each side.

The top end of the front upright has slots for attaching an upper border panel. This border panel consists of a rectangular laminar sheet, the sides whereof have L-shaped tabs that are bent backwards for attaching to the slots in the front upright. This border panel makes it possible to provide an even finish as a support for the ornamental motif on the front, together with the front covers and the lower base panels.

In turn, each rear upright consists of a laminar piece with a U-shaped section, the centre whereof has a line of slots for the frontal attachment of panels and holes in the side wings for assembly of the means of fastening to a wall or rear vertical element against which the columbarium is erected.

According to the invention, the crossbar comprises the blocking element that consists of a laminar body with a U-shaped section so that it can move easily inside the longitudinal guide. The front of this blocking element has an opening that provides access for a tool and two slots on each side for inserting and removing the tabs of the adjacent front covers, these slots being positioned respectively at two heights for each of said covers.

The front cover consists of a rectangular laminar body, the upper and lower sides whereof have tabs that are bent backwards and in opposite directions to be secured by the blocking elements of the adjacent crossbar. Thus, the two blocking elements are capable of retaining the front cover, which is attached to the crossbars and secured by elastic elements between tabs on the longitudinal guide and on the blocking elements in a resting position.

According to the invention, the sides of the columbarium consist of one or more side panels positioned above one another. The upper and lower sides of these side panels comprise a plurality of tabs bent alternately to one side and the other to form two side channels in collaboration with the tabs on an upper or lower adjacent side panel, thus providing a support for the shelves.

The tabs on the front side of the side panels are U-shaped and alternately face in one direction and the other. These tabs have holes and welded nuts for bolting to the inside of the front upright from the side wing of said uprights.

As has been mentioned above, the side of the structure consists of two or more side panels, which present means of forming different levels of support for successive shelves at different heights. For this purpose, the surface of the side panels has sets of windows that are aligned from front to back, which have tabs that are bent alternately to one side and the other, whereon to place the intermediate shelves for depositing cinerary urns. Thus, each pair of urns can take up two or more levels of shelves.

Each of these shelves that form the floor and ceiling of each of the inner spaces or openings consists of a rectangular sheet, both longitudinal sides whereof have a tab that is bent in a sideways U shape that rests in the channels defined by the tabs on the side panels.

To fasten the structure of the columbarium against the rear support wall, it is provided with brackets for fastening the back of the rear uprights to the wall.

The height-adjustable legs consist of a laminar body that is bent into a U shape with front anchoring slots and side connection nuts, one end of it being closed, wherein an adjustable bolt is situated in a longitudinal position, thereby ensuring that they rest firmly on the ground.

It is anticipated that fastened to the outer face of the front closure covers is a ceramic plaque, a natural or synthetic stone slab, a plastic photographic print or suchlike, which forms part of the whole mural or mosaic that is the final artistic and decorative object of the columbarium in its permanent position. Each piece is duly labelled with a reference in order to facilitate the composition of the mural and its subsequent location for restoration or repairs.

BRIEF DESCRIPTION OF THE DRAWINGS

To complement this description and in order to aid a better understanding of the invention's characteristics, there is a set of illustrative and non-limitative drawings integral to said description, which is as follows.

DESCRIPTION OF THE PREFERRED EMBODIMENTS

Figure 1:
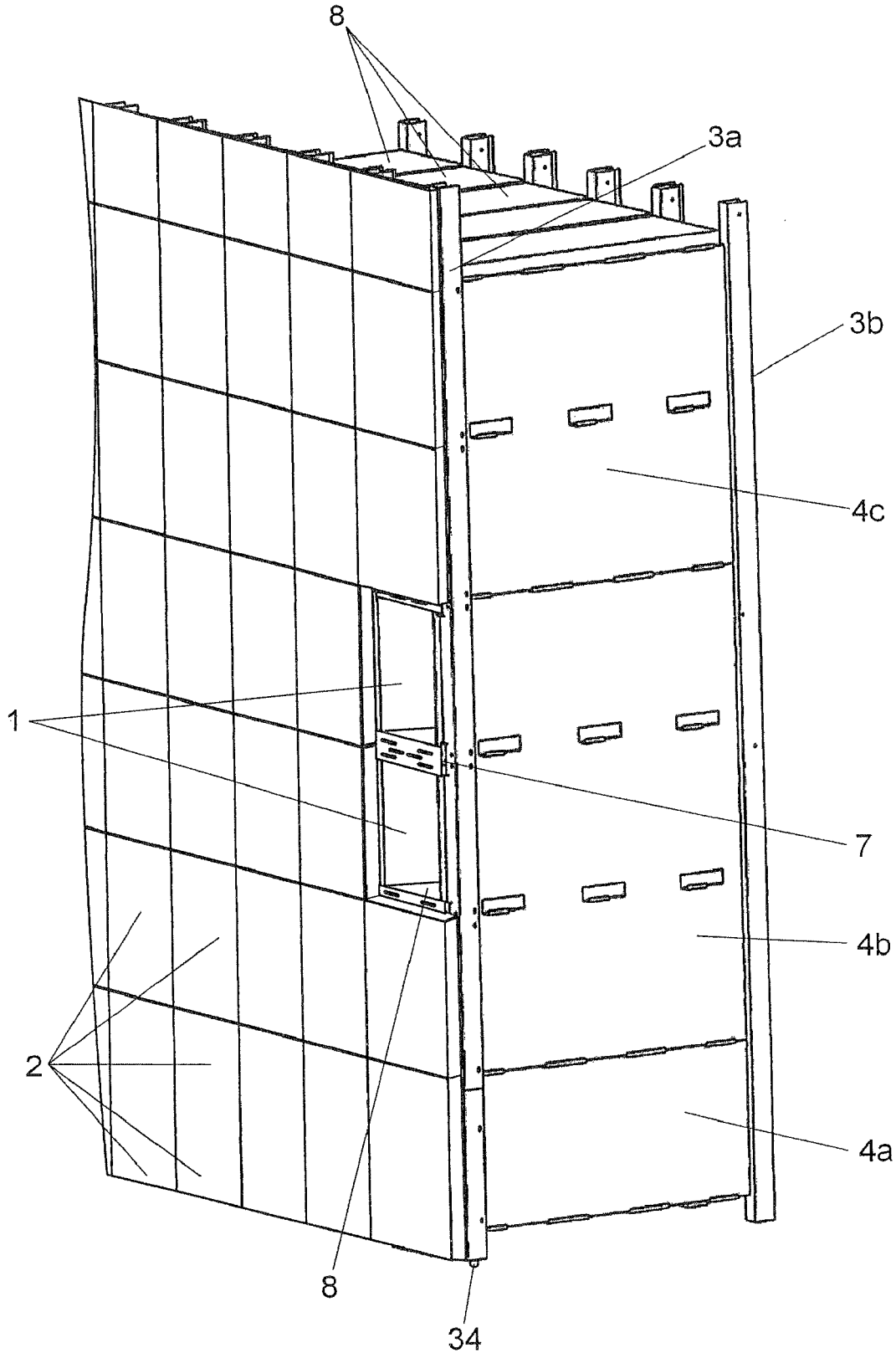
FIG. 1 shows a perspective view of a columbarium with the front mural and two open spaces for access.
Figure 2:
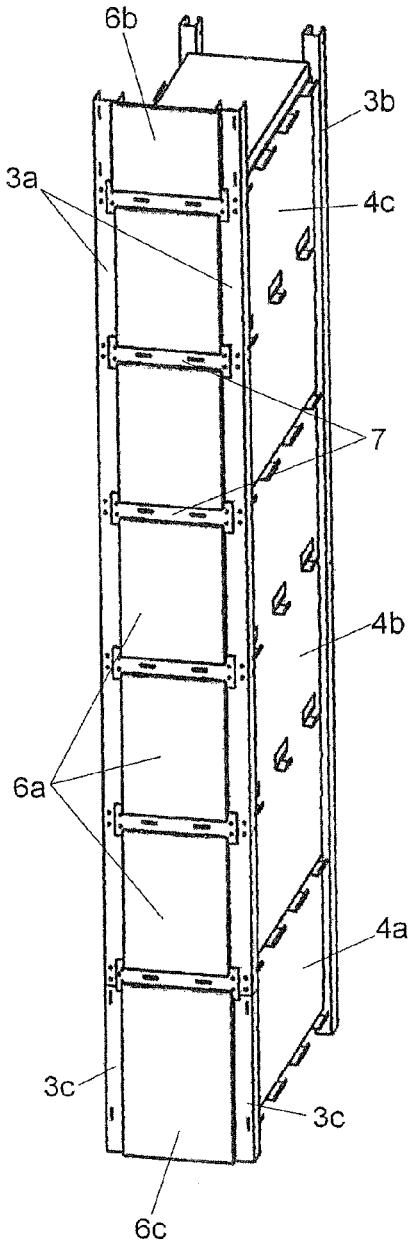
FIG. 2 shows a perspective view of a column or module of the columbarium.
Figure 3:
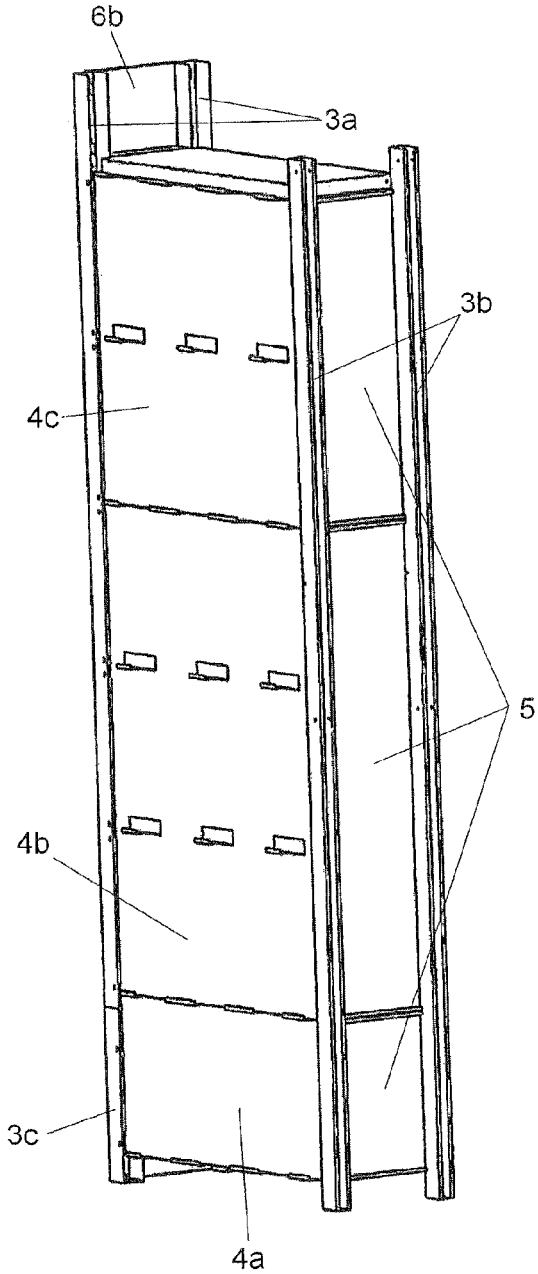
FIG. 3 shows a perspective view of the back of a column of the columbarium.

As can be observed in the aforementioned figures, the columbarium consists of a succession of modular structures, the sides whereof can be attached to one another to form a plurality of spaces (1) wherein to house cinerary urns, and the front surface of the structure can have a decorative motif consisting of a plurality of pieces (2) of a front ornamental mural, as shown in FIG. 1.

Each modular structure consists of two pairs of uprights (3*a*, 3*b*) positioned at the front and rear, side panels (4*a*, 4*b*, 4*c*') positioned between the uprights (3*a*, 3*b*) on each side, rear panels (5) positioned on the rear uprights (3*b*) and openable front covers (6*a*) mounted on transversal crossbars (7) between the two front uprights (3*a*), there being an upper border panel (6*b*) at the top of said front uprights (3*a*), whilst there are height-adjustable legs (3*c*) and a lower base panel (6*c*) at the bottom of these front uprights (3*a*). Inside the structure are a number of horizontal shelves (8) that will form the floor and ceiling of regular spaces (1) positioned one above another in columns to house cinerary urns.

Figure 6:
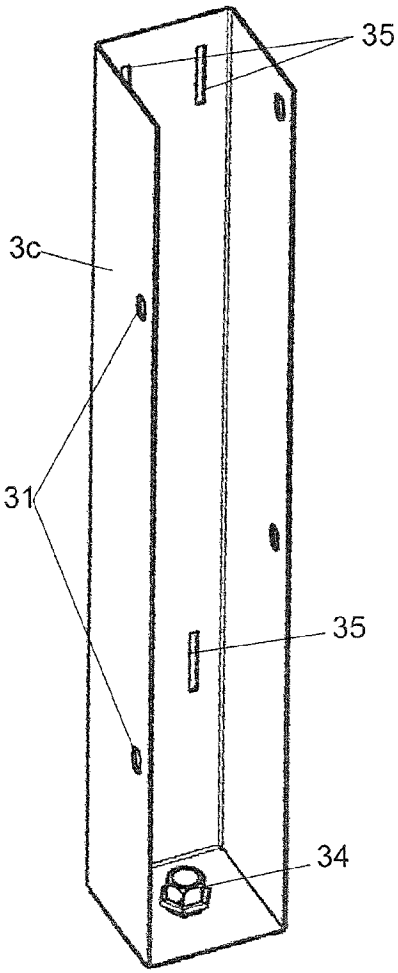
FIG. 6 shows a perspective view of a height-adjustable leg.
Figure 4:
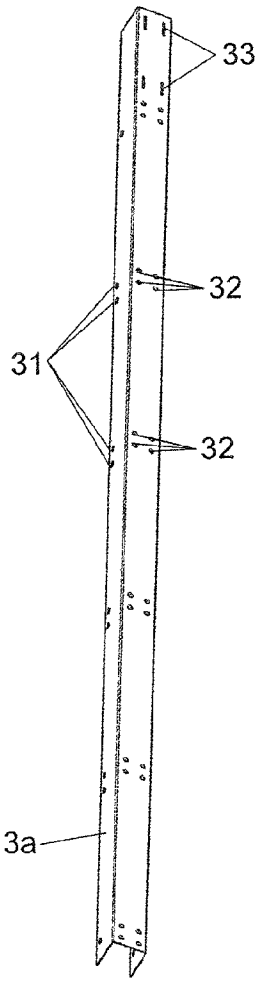
FIG. 4 shows a perspective view of a front upright.

Thus, each front upright (3*a*), shown in FIG. 4, consists of a laminar piece with a U-shaped section, both side wings whereof have holes (31) for the bolts that fasten the side panels (4*a*, 4*b*, 4*c*), whilst the front face of said front uprights (3*a*) has groups of holes (32) for attaching the crossbars (7) on each side. The top end of each front upright (3*a*) has slots (33) for attaching an upper border panel (6*b*). As has been mentioned above, the bottom of each front upright (3*a*) is extended in the form of a height-adjustable leg (3*c*), shown in FIG. 6, which consists of a laminar element that is bent into a U shape, of the same characteristics as the adjacent front upright (3*a*), the bottom end of this height-adjustable leg (3*c*) being closed, with a longitudinally adjustable bolt (34). The front of said height-adjustable leg (3*c*) has slots (35) for attaching the base panel (6*c*). And the side wings of the height-adjustable leg (3*c*) have holes (31) with nuts for fastening to an adjacent side panel (4*a*).

Figure 7:
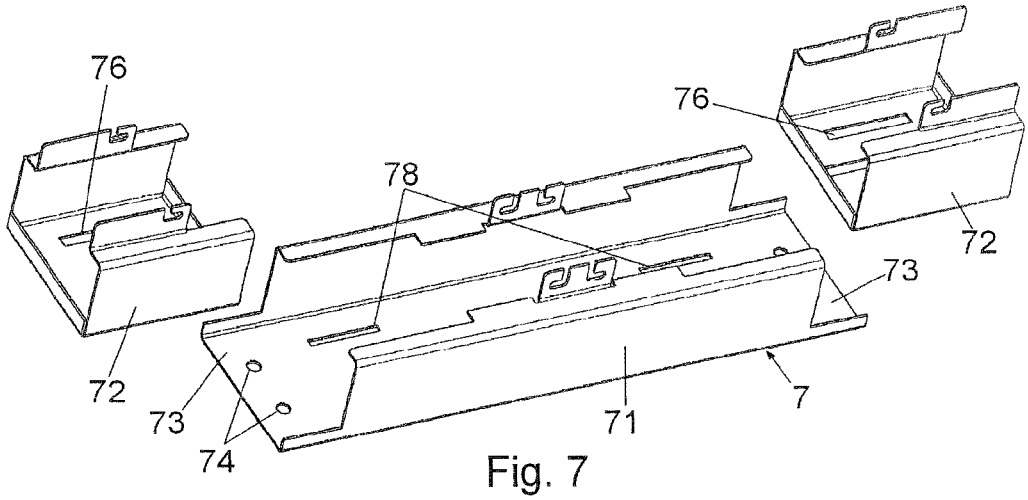
FIG. 7 shows an exploded view of a crossbar.
Figure 8:
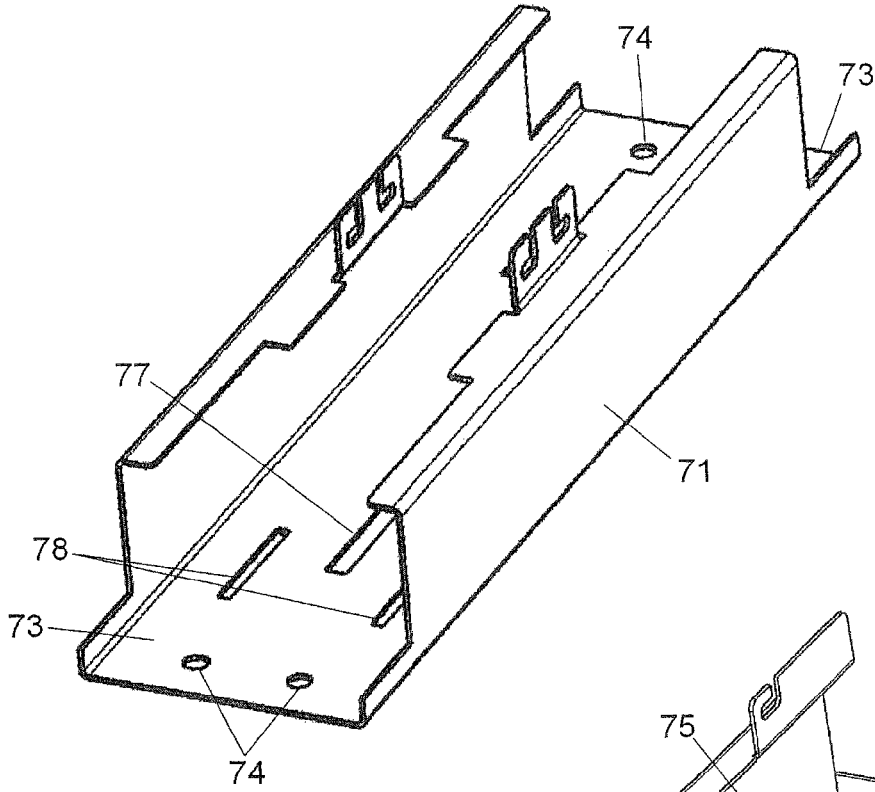
FIG. 8 shows a perspective view of the back of the longitudinal guide of the crossbar.
Figure 9:
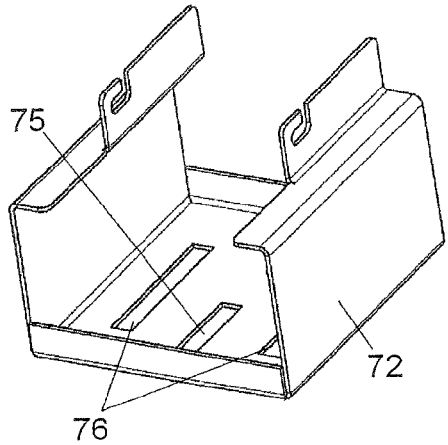
FIG. 9 shows a perspective view of the back of the blocking element of the crossbar.

Between the front uprights (3*a*) are the crossbars (7) that join them and define the upper and lower limits of each space (1) together with the shelves (8). Each crossbar (7), shown in FIGS. 7, 8 and 9, consists of a longitudinal guide (71), whereon blocking elements (72) are positioned that can move laterally along them. The longitudinal guide (71) of the crossbar (7) consists of a laminar body that is bent in a U shape; at each end whereof it has a projecting tab (73) with holes (74) for bolting to the holes (32) in the front upright (3*a*). The blocking elements (72) are also U-shaped so that they can be movably positioned inside the longitudinal guide (71), pushed by elastic elements (not shown). The front of the blocking element (72) has an opening (75) that provides access for a tool and two parallel slots (76) for inserting and removing upper and lower tabs (61) of the adjacent front covers (6*a*). The longitudinal guide (71), in turn, also comprises an opening (77) to provide access for a tool and a pair of parallel slots (78) for each blocking element (72) wherein into the front covers (6*a*) are attached, aided by an opening (75) and the slots (76) of the blocking element (72).

The front closure covers (6*a*) consist of a rectangular laminar body, the lower and upper sides whereof have blocking tabs on the crossbars (7), these tabs (61) being bent inwards and positioned opposite each other. Fastened to the front of each cover (6*a*), border panel (6*b*) and base panel (6*c*) is a piece (2), in this case a ceramic plaque with a photographic print, which forms part of the whole front mural, the final artistic and decorative object of the columbarium in its permanent position, each piece (2) being labelled with a reference for its installation and repair.

Figure 14:
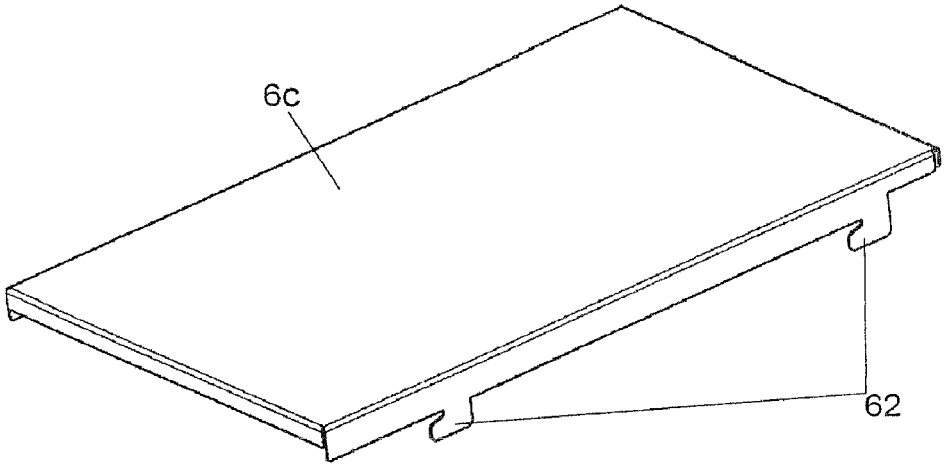
FIG. 14 shows a perspective view of the lower base panel of the columbarium.
Figure 15:
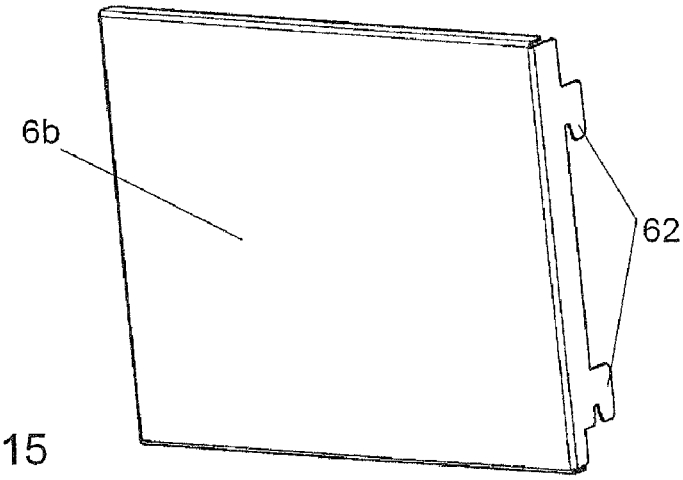
FIG. 15 shows a perspective view of the upper border panel of the columbarium.

Both the border panel (6*b*) and the base panel (6*c*), shown in FIGS. 14 and 15, consist of rectangular laminar sheets, the sides whereof have L-shaped tabs (62) for fastening to the front upright (3*a*) and the height-adjustable leg (3*c*).

Figure 5:
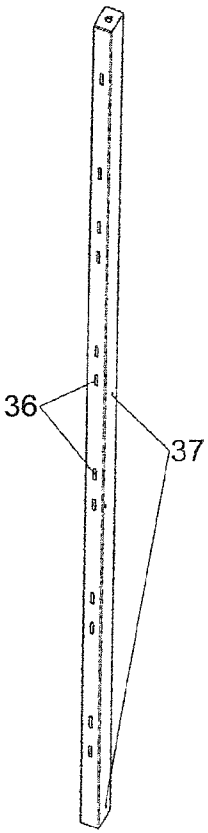
FIG. 5 shows a perspective view of the back of a rear upright.
Figure 18:
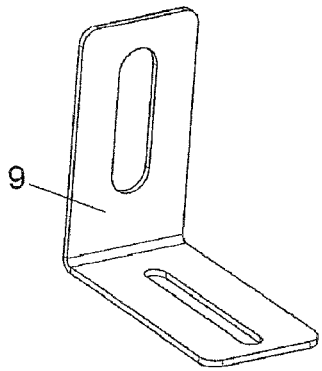
FIG. 18 shows a perspective view of the wall fastening bracket.

The upright (3*b*), shown in FIG. 5, consists of a laminar piece with a U-shaped section, the centre whereof has a line of slots (36) for attaching rear panels (5) and side panels (4*a*, 4*b*, 4*c*), whilst the side wings have holes (37) for fastening it to the wall by means of brackets (9), shown in FIG. 18.

Figure 10:
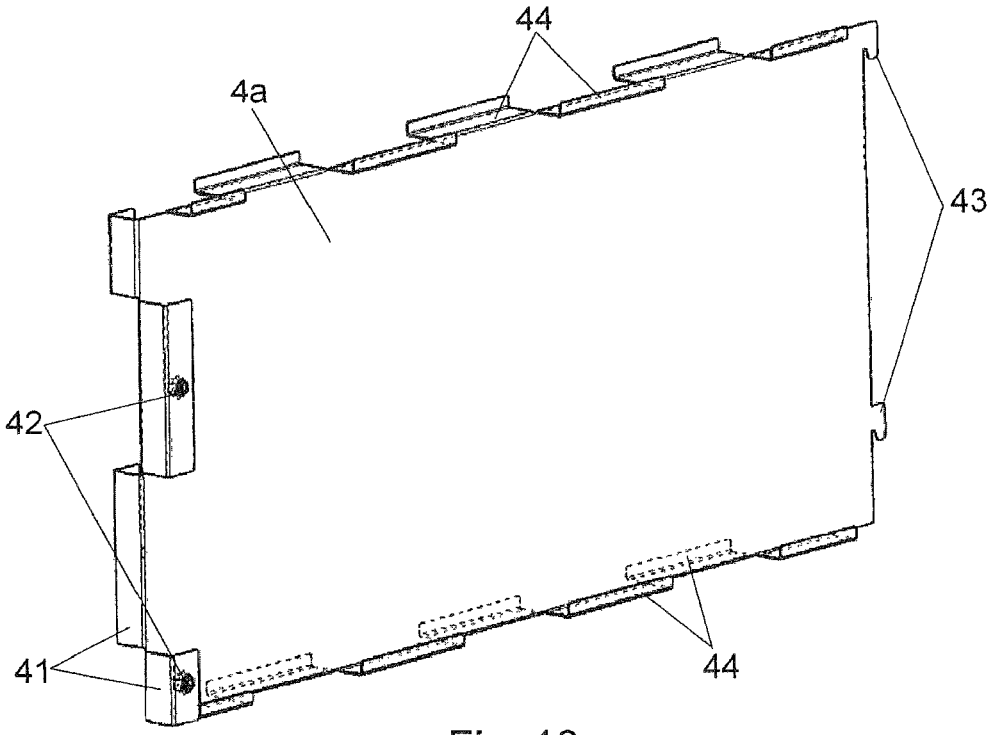
FIGS. 10, 11 and 12 show perspective views of several side panels, of a single and multiple height.
Figure 11:
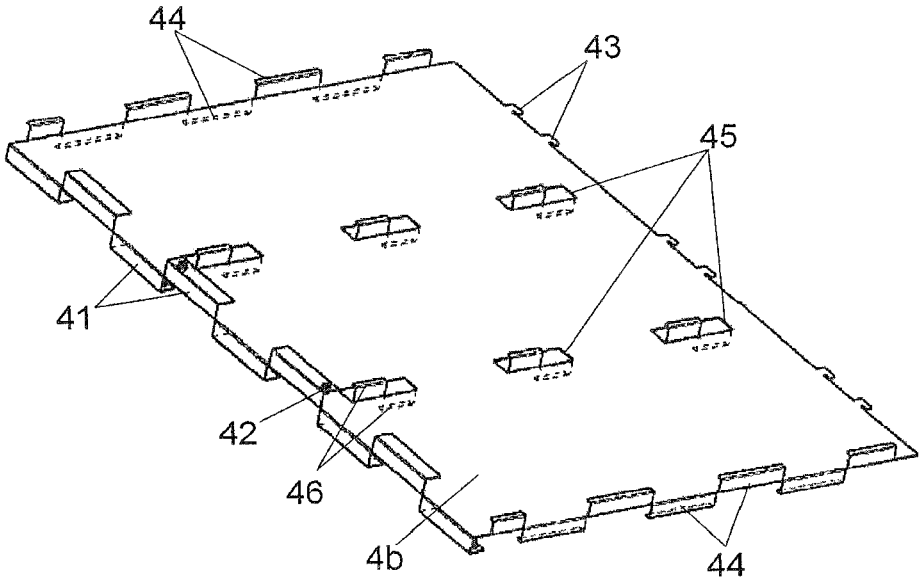
Figure 12:
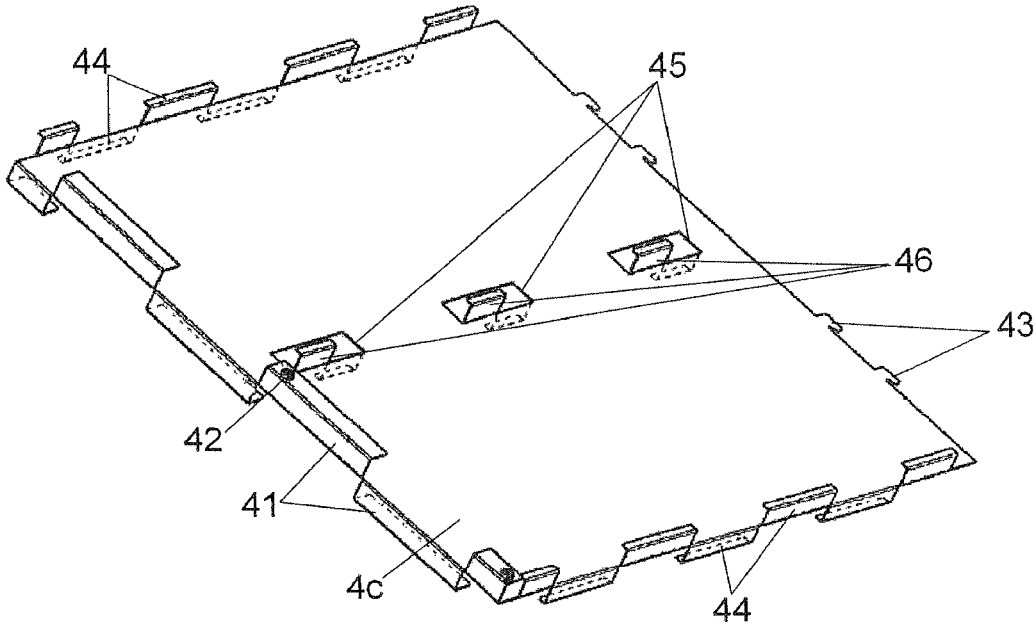
Figure 13:
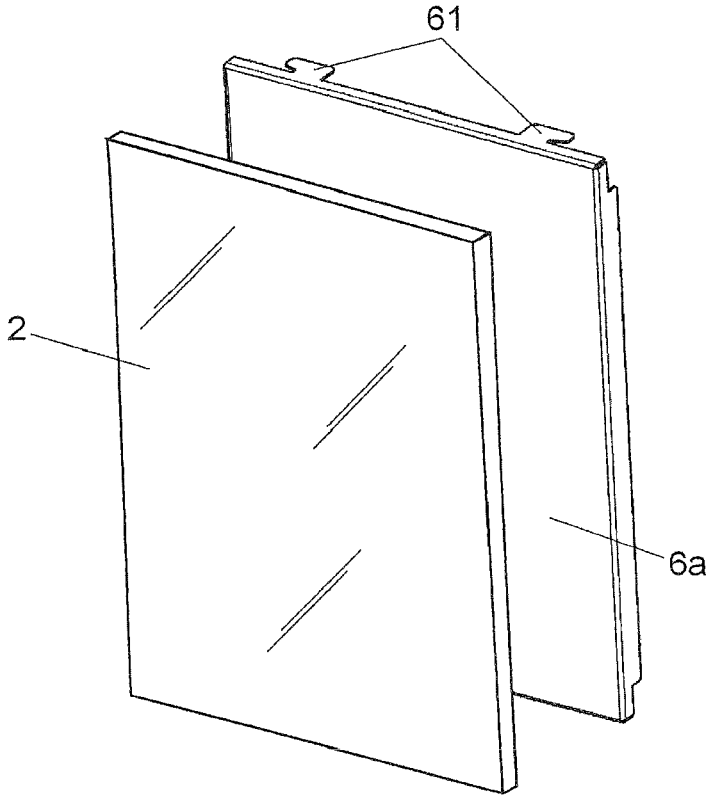
FIG. 13 shows a perspective view of the upper border panel and the attachment of the front decorative piece of the mural.

The side panels (4*a*, 4*b*, 4*c*), shown in FIGS. 10, 11, 12, comprise three types of panels of different heights, as they can form the side walls of different spaces (1) for housing cinerary urns. Each side panel (4*a*, 4*b*, 4*c*) consists of a rectangular laminar sheet, the front whereof has front tabs (41) that are bent in a U shape and alternately face in one direction and the other, these tabs (41) having holes (42) and nuts for fastening to the side wings of the front uprights (3*a*), whilst the rear side has L-shaped tabs (43) for fastening to the front slots (36) in the upright (3*b*). The upper and lower sides of each side panel (4*a*, 4*b*, 4*c*) comprise a plurality of tabs (44) that are bent alternately to one side and the other to form two side channels in collaboration with the tabs (44) on an upper or lower adjacent side panel (4*a*, 4*b*, 4*c*), said channels thus providing a support for the shelves (8).

The intermediate and upper side panels (4*b*, 4*c*) have a triple and double height, respectively, and their surface comprises sets of windows (45) that are aligned from front to back, which have tabs (46) that are bent alternately to one side and the other, whereupon to place intermediate shelves (8) for depositing cinerary urns, the side panels (4*b*, 4*c*) thus covering two or three storage spaces (1).

Figure 16:
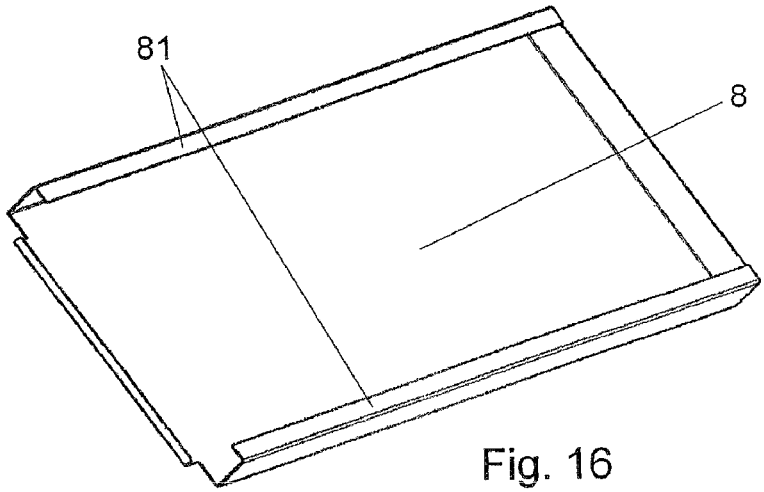
FIG. 16 shows a perspective view of the underside of a shelf, making it possible to see the longitudinal support tabs.

Each of the shelves (8), shown in FIG. 16, consists of a rectangular laminar sheet, both longitudinal sides whereof have a tab (81) bent into a sideways U shape that rests in the channels defined by the tabs (44, 46) of the side panels (4*a*, 4*b*, 4*c*).

Figure 17:
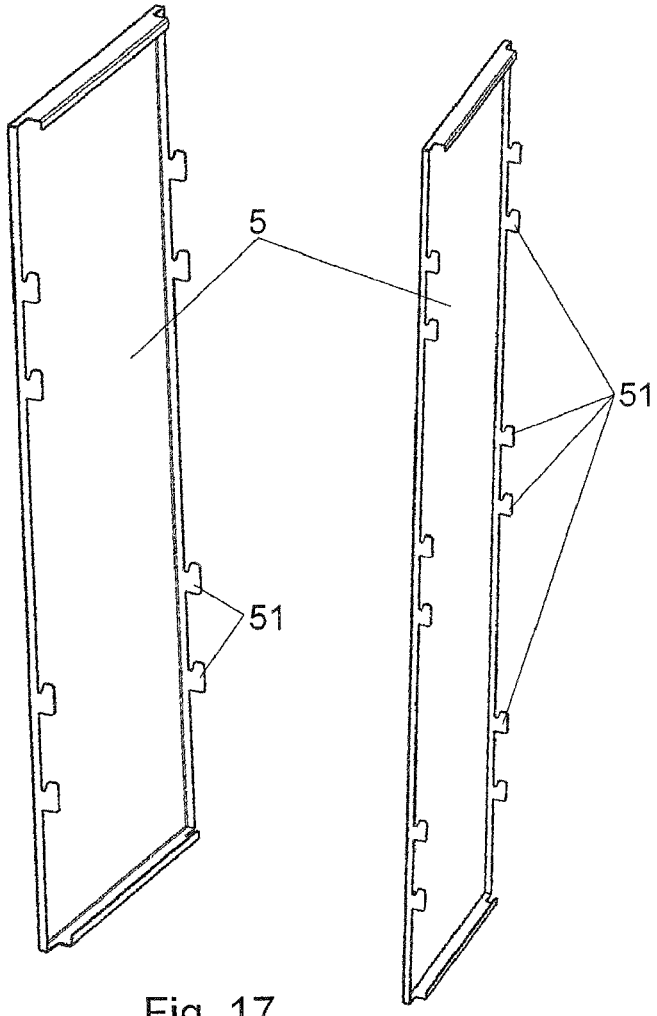
FIG. 17 shows a perspective view of two rear panels.

The rear part of the structure, in turn, consists of several rectangular rear panels (5), shown in FIG. 17, with tabs (51) that are bent to one side for fastening to the slots (36) of the rear uprights (3*b*).

Having adequately described the nature of the invention, as well as an example of a preferred embodiment, it must be noted that the materials, form, size and layout of the described elements may be modified, provided that this does not involve altering the essential characteristics of the invention disclosed in the following claims.

The invention claimed is:

1. Modular columbarium, of the type that comprises a modular structure with a number of uprights (3*a*, 3*b*) positioned at the front and rear of the unit, with side panels (4*a*, 4*b*, 4*c*), rear panels (5) and openable front covers (6*a*) on front crossbars (7), the unit being joined, it being possible to install a number of horizontal shelves (8) that will form the floor and ceiling of regular spaces (1) positioned one above another in columns to house cinerary urns, and it being possible to laterally attach this structure to an adjacent structure, the front covers (6*a*) forming a matrix whereto a mural or mosaic of decorative elements may be fastened, characterised in that the structure comprises side panels (4*a*, 4*b*, 4*c*) bolted to front uprights (3*a*) by bent front tabs (41) on said side panels (4*a*, 4*b*, 4*c*), and said side panels (4*a*, 4*b*, 4*c*) are joined to the rear uprights (3*b*) by L-shaped tabs (43) that can be housed in slots (36) in said rear uprights (3*b*), the bottom of the front uprights (3*a*) being extended by height-adjustable legs (3*c*) to adapt to any unevenness of the ground, a lower base panel (6*c*) being fastened between the legs (3*c*), whilst said front uprights (3*a*) are connected to each other by the front crossbars (7), each crossbar (7) comprising a longitudinal guide (71), whereon blocking elements (72) are positioned that can move laterally along it, the longitudinal guide (71) having slots (78) wherethrough projecting tabs (61) for fastening the front covers (6*a*) can pass and central openings (78) wherethrough the blocking elements (72) can be actuated to block or release said front covers (6*a*); and in that the rectangular laminar rear panels (5) have side tabs (51) that are bent to one side for fastening to the slots (36) in the rear uprights (3*b*).

2. Columbarium, according to claim 1, characterised in that each front upright (3*a*) consists of a laminar piece with a U-shaped section, both side wings whereof have holes (31) for the bolts that fasten the side panels (4*a*, 4*b*, 4*c*), and the front whereof has groups of holes (32) for attaching the longitudinal guides (71) of the crossbars (7) on each side.

3. Columbarium, according to claim 2, characterised in that the top end of the front uprights (3*a*) has slots (33) for attaching an upper border panel (6*b*).

4. Columbarium, according to claim 3, characterised in that the border panel (6*b*) consists of a rectangular laminar sheet, the sides whereof have L-shaped tabs (62) that are bent backwards for attaching to the slots (33).

5. Columbarium, according to claim 1, characterised in that each rear upright (3*b*) consists of a laminar piece with a U-shaped section, the centre whereof has a line of said slots (36) for the frontal attachment of side panels (4*a*, 4*b*, 4*c*) and rear panels (5), the side wings having holes (37) for assembly of the means of fastening to a wall or rear vertical element.

6. Columbarium, according to claims 1, characterised in that each end of the longitudinal guide (71) of the crossbar (7) has a projecting tab (73) with holes (74) for fastening to the front upright (3*a*).

7. Columbarium, according to claim 1, characterised in that the crossbar (7) comprises the blocking element (72) that consists of a laminar body with a U-shaped section, the front whereof has an opening (75) that provides access for a tool and two slots (76) for inserting and removing the tabs (61) on the adjacent front covers (6*a*).

8. Columbarium, according to claim 1, characterised in that the front cover (6*a*) consists of a rectangular laminar body, the upper and lower sides whereof have tabs (61) that are bent backwards and in opposite directions to be secured by the blocking elements (72) of the adjacent crossbar (7).

9. Columbarium, according to claim 1, characterised in that the upper and lower sides of the side panels (4*a*, 4*b*, 4*c*) comprise a plurality of tabs (44) bent alternately to one side and the other to form two side channels in collaboration with the tabs (44) on an upper or lower adjacent side panel (4*a*, 4*b*, 4*c*), thus providing a support for the shelves (8).

10. Columbarium, according to claim 1, characterised in that the tabs (41) on the front side of the side panels (4*a*, 4*b*, 4*c*) are U-shaped and bent to one side and the other alternately, with holes (42) and welded nuts for bolting to the inside of the front uprights (3*a*).

11. Columbarium, according to claim 1, characterised in that the surface of the side panels (4*b*, 4*c*) has sets of windows (45) that are aligned from front to back, which have tabs (46) that are bent alternately to one side and the other, whereon to place intermediate shelves (8) for depositing cinerary urns.

12. Columbarium, according to claim 1, characterised in that the shelves (8) that form the floor and ceiling of each of the inner spaces (1) or openings consists of a rectangular sheet, both longitudinal sides whereof have a tab (81) that is bent in a sideways U shape that rests in the channels defined by the tabs (44, 46) on the side panels (4*a*, 4*b*, 4*c*).

13. Columbarium, according to claim 1, characterised in that the back of the rear uprights (3*b*) comprises brackets (9) for fastening to the wall.

14. Columbarium, according to claim 1, characterised in that the height-adjustable legs (3*c*) consist of a laminar element that is bent into a U shape with slots (35) for attaching the base panel (6*c*) and side holes for attaching a side panel (4*a*), having a closed end, wherein a longitudinally adjustable bolt (34) is situated.

15. Columbarium, according to claim 1, characterised in that fastened to the front of each front closure cover (6*a*), border panel (6*b*) and base panel (6*c*) is a piece (2), wherein the piece includes a ceramic plaque, a natural or synthetic tone slab, a plastic photographic print, that forms part of a whole mural or mosaic that is the final artistic and decorative object of the columbarium in its permanent position, each piece (2) being duly labelled with a reference in order to facilitate the composition of the mural and its subsequent location for restoration or repairs.

* * * * *